US011589626B2

(12) United States Patent
Carter

(10) Patent No.: US 11,589,626 B2
(45) Date of Patent: Feb. 28, 2023

(54) APPAREL WITH INTEGRATED GLOVES

(71) Applicant: Linda Carter, Lake Elsinore, CA (US)

(72) Inventor: Linda Carter, Lake Elsinore, CA (US)

( * ) Notice: Subject to any disclaimer, the term of this patent is extended or adjusted under 35 U.S.C. 154(b) by 248 days.

(21) Appl. No.: 17/038,981

(22) Filed: Sep. 30, 2020

(65) Prior Publication Data

US 2021/0007425 A1 Jan. 14, 2021

Related U.S. Application Data

(63) Continuation-in-part of application No. 16/012,373, filed on Jun. 19, 2018, now abandoned.

(51) Int. Cl.
*A41D 19/00* (2006.01)
*A41D 27/10* (2006.01)

(52) U.S. Cl.
CPC ..... *A41D 19/0044* (2013.01); *A41D 27/10* (2013.01)

(58) Field of Classification Search
CPC ..... A41D 19/0044; A41D 19/0041; A41D 19/0089
See application file for complete search history.

(56) References Cited

U.S. PATENT DOCUMENTS 361,250 A * 4/1887 Wright ..... A41D 19/0041 2/125
1,092,047 A * 3/1914 Hertz ..... A41D 19/0041 2/270
1,183,792 A * 5/1916 Aron ..... A41D 27/10 2/270
2,104,826 A * 1/1938 Stramiello ..... A41B 1/08 2/269
2,136,879 A * 11/1938 Haber ..... A41D 27/10 2/270
2,226,066 A * 12/1940 Moe ..... A41D 27/10 2/270

(Continued)

*Primary Examiner* — Alissa L Hoey
(74) *Attorney, Agent, or Firm* — Barry Choobin; Patent 360

(57) ABSTRACT

The present invention is directed to upper-body apparel having integrated gloves, wherein the gloves can easily switch between a stowed position and a donned position. The apparel comprises a pair of sleeves, each sleeve having an opening configured for extending a hand, the sleeve having an upper portion and a lower portion, the sleeve opening having an upper segment and a lower segment each extending along circumference of the sleeve opening, the upper segment extends along the upper portion of the sleeve and the lower segment extends along the lower portion of the sleeve. A glove having a palm side, a rear side, and a glove opening, a palm segment of the periphery of the glove opening extends along the palm side of the glove, and a rear segment of the periphery of the glove opening extends along the rear side of the glove. A flap having a front edge and an opposite rear edge, the rear edge having two opposite corners, the flap is made of stretchable material. The upper segment of the sleeve opening is coupled to the rear segment of the glove opening. The palm segment of the glove opening is coupled to the front edge of the flap, the two opposite corners of the rear edge of the flap coupled to the upper portion of the sleeve. The glove is sandwiched between the upper portion of the sleeve and the flap.

14 Claims, 6 Drawing Sheets

(56) References Cited

U.S. PATENT DOCUMENTS 2,274,510 A * 2/1942 Wohl ..... A41D 19/0041 D2/614
2,340,017 A * 1/1944 Rasmussen ..... A41D 19/0041 2/270
2,421,848 A * 6/1947 Philipps ..... A41D 19/0041 2/270
3,214,771 A * 11/1965 Treiber ..... A41D 27/10 2/270
4,297,746 A * 11/1981 Zarbos ..... A41D 19/0041 2/108
4,773,100 A * 9/1988 Kuo ..... A41D 27/10 2/232
4,933,992 A * 6/1990 Kallman ..... A41D 19/00 2/160
4,944,041 A * 7/1990 Buenos ..... A41D 19/0041 2/84
5,125,117 A * 6/1992 Buenos ..... A41D 27/10 2/270
5,509,143 A * 4/1996 Yates ..... A41D 19/01535 2/160
5,628,064 A * 5/1997 Chung ..... A41D 15/00 2/119
5,815,837 A * 10/1998 Christman ..... A41D 19/0041 2/125
6,253,381 B1 * 7/2001 Kelley ..... A41D 3/02 2/125
6,349,413 B1 * 2/2002 Rose ..... A41D 1/06 2/269
6,839,911 B1 * 1/2005 Mathews ..... A41D 15/00 2/93
8,904,566 B2 * 12/2014 Clark ..... A41D 19/01 2/169
10,306,936 B2 * 6/2019 Kreft ..... A41D 19/002
10,849,376 B2 * 12/2020 Evans ..... A01K 89/003
11,064,747 B2 * 7/2021 Zahradka ..... A41D 27/10
2003/0154536 A1 * 8/2003 Anderson ..... A41D 3/02 2/108
2012/0060256 A1 * 3/2012 Parker ..... A41D 19/0041 2/85
2012/0227153 A1 * 9/2012 Laycock ..... A41D 27/10 2/88
2013/0232658 A1 * 9/2013 Thomas ..... A41D 19/01 2/69
2014/0250565 A1 * 9/2014 Willows ..... A41D 19/0006 2/163
2017/0231302 A1 * 8/2017 Rhodes ..... A41D 19/01 2/69
2018/0064190 A1 * 3/2018 Khan ..... A41D 15/002
2018/0071173 A1 * 3/2018 Hunter ..... A41B 13/005
2018/0295909 A1 * 10/2018 Carter ..... A41D 19/0041
2018/0310648 A1 * 11/2018 Rhodes ..... A41D 27/10

* cited by examiner

APPAREL WITH INTEGRATED GLOVES

CROSS-REFERENCE TO RELATED APPLICATIONS

This application is a continuation-in-part of a U.S. Non-provisional patent application with Ser. No. 16/012,373, filed on Jun. 19, 2018, which claims priority from a U.S. provisional patent application with Ser. No. 62/603,962 filed on Jun. 19, 2017, both of which are incorporated herein by reference in its entirety.

FIELD OF INVENTION

The present invention relates to an apparel, and more particularly, the present invention relates to an upper body apparel with integrated gloves.

BACKGROUND

In wintry weather, the use of warm clothes is essential to keep the body warm. Besides the warm clothes, warm socks are used to prevent loss of body heat from feet. Hoods are generally used to cover the head and ears. Scarves and similar clothing accessories are available to cover the neck. Hands can be protected with warm gloves. Warm gloves, also known as mittens, could be donned in hands to keep the hands warm. However, the gloves limit the functionality of the hands. Hands are essential for performing activities, such as daily chores, professional work, and like. For example, the gloves may make typing difficult. For students, the gloves may make the writing with pen difficult if not impossible. Therefore, people generally withdraw the gloves before performing activities involving the hands.

The withdrawn gloves can be kept at a workplace, in the pockets, and any suitable places. However, there are chances that the user may forget to take the gloves from the workplace. Or the gloves may get misplaced. Also, the gloves may accidentally fall from the pocket. Therefore, there is a long-standing need for a utility article that can provide safe-keeping of the gloves. Particularly, a need is there for a utility article that can stow the glove when not in use.

The terms "apparel" and "garment" are interchangeably used hereinafter and refers to an article of clothing, and specifically the clothing for upper body.

The above mentioned shortcomings, disadvantages and problems are addressed herein, and which will be understood by reading and studying the following specification

SUMMARY OF THE INVENTION

The principal object of the present invention is therefore directed to an upper body garment with integrated gloves.

It is another object of the present invention that the gloves can be switched between a stowed position and donned position.

It is yet another object of the present invention that the apparel saves the glove from accidental drop.

It is an additional object of the present invention that the apparel avoids the need of storing the gloves in a suitable place.

It is an additional object of the present invention that the apparel obviates the chances of misplacing the gloves.

It is still an additional object of the present invention that the user no longer has to remember carrying the gloves.

It is a further object of the present invention that the apparel is economical to manufacture.

These and other objects and advantages of the embodiments herein will become readily apparent from the following summary and the detailed description taken in conjunction with the accompanying drawings.

In one aspect, disclosed is upper-body apparel having integrated gloves, wherein the gloves can easily switch between a stowed position and a donned position. The apparel disclosed herein comprises a pair of sleeves, each sleeve having an opening configured for extending a hand, the sleeve having an upper portion and a lower portion, the sleeve opening having an upper segment and a lower segment each extending along circumference of the sleeve opening, the upper segment extends along the upper portion of the sleeve and the lower segment extends along the lower portion of the sleeve. A glove having a palm side, a rear side, and a glove opening, a palm segment of the periphery of the glove opening extends along the palm side of the glove, and a rear segment of the periphery of the glove opening extends along the rear side of the glove. A flap having a front edge and an opposite rear edge, the rear edge having two opposite corners, the flap is made of stretchable material. The upper segment of the sleeve opening is coupled to the rear segment of the glove opening. The palm segment of the glove opening is coupled to the front edge of the flap, the two opposite corners of the rear edge of the flap coupled to the upper portion of the sleeve. The glove is sandwiched between the upper portion of the sleeve and the flap.

In one aspect, the flap is configured to be pulled through the rear edge in an angular direction and invert over the lower portion of the sleeve. The glove is configured to switch between a stowed position and a donned position, the glove in the stowed position is sandwiched between the flap and the upper portion of the sleeve, while in the donned position the glove is donned in the hand.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein includes all such modifications.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
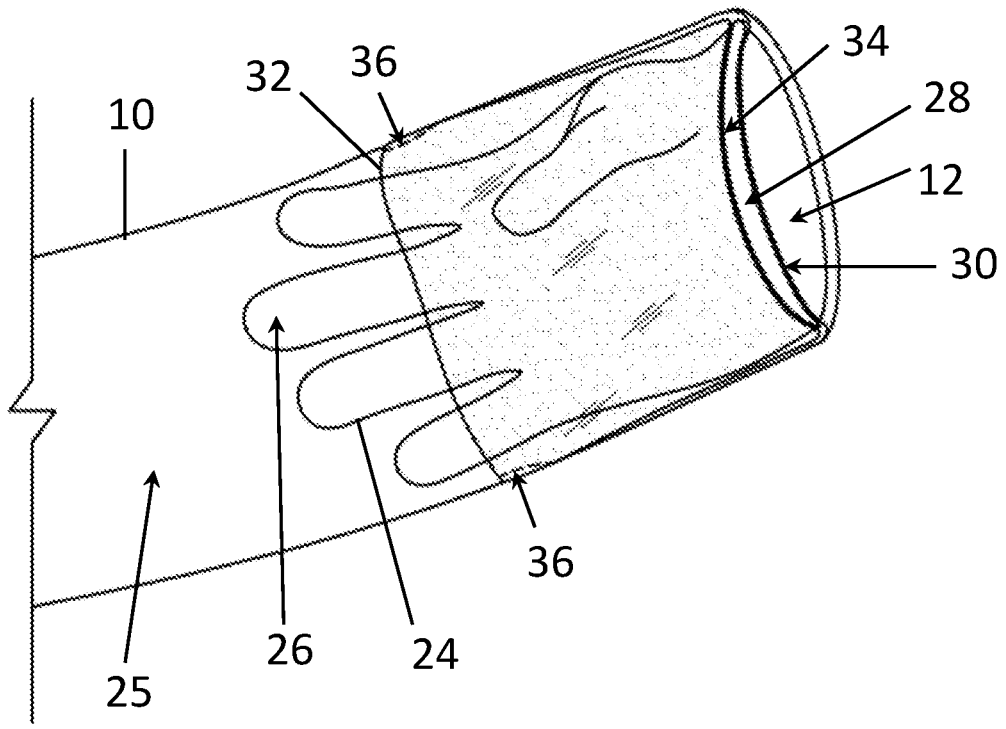
FIG. 1 is a perspective view of a sleeve with glove, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as devices and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details.

Disclosed is upper-body apparel that is having full sleeves, each sleeve is coupled with a glove, wherein the glove can be switched between a donned position and stowed position. The upper body apparel, referred herein as the apparel, can be any pullover like a jacket, jersey, and like. In the donned position, the gloves are donned in the hand while in the stowed position, the gloves are stowed on the sleeve. The disclosed apparel is provided with a mechanism for stowing the integrated gloves over the sleeves of the apparel. Additionally, the sleeves can be interchangeably attached to the apparel, for example using a zipper. This may allow using the sleeves with distinct garments, for example, the same sleeve can be used with two or more sleeveless jackets.

Figure 2:
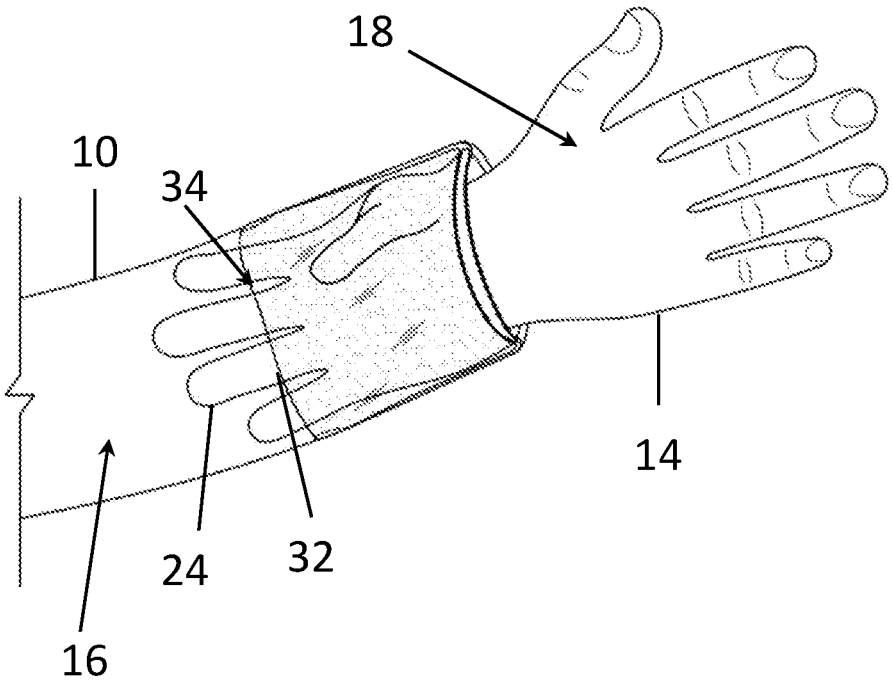
FIG. 2 shows the sleeve for the right hand, according to an exemplary embodiment of the present invention.

Now referring to FIGS. 1-2 which shows an exemplary embodiment of the disclosed apparel. The sleeve 10 is having an opening 12 for extending a hand 14. The sleeve 10 can have an upper portion 16 that is along the rear side 18 of the hand 14. Opposite the upper portion of the sleeve is the rear portion 20 that is along the palm side 22 (shown in FIG. 4) of the hand 14. Although the sleeve is of a continuous cylindrical shape and the sleeve opening is of a continuous circumference, the circumference of the opening of the sleeve is assumed to be divided into two halves, an upper segment, and a lower segment. The periphery of the sleeve opening 12 along the upper portion 25 of the sleeve is referred herein as the upper segment of the sleeve opening and the other half periphery of the sleeve opening is referred herein as the lower segment of the sleeve opening. The upper segment and the lower segment of the sleeve opening are along the circumference of the sleeve opening 12.

The glove 24 is shown in FIG. 1 is having a palm side 26 and a rear side that is opposite the palm side 26. The palm side of the glove covers the palm side of the hand while the rear side of the glove covers the rear side of the hand. The glove 24 is having an opening 28, referred hereinafter as the glove opening 28, for receiving the hand 14. Like the sleeve opening, the glove opening can also have a continuous circumference that is assumed to be divided into two segments i.e. a palm segment and a rear segment. The periphery of the glove opening 28 along the palm side 26 of the glove is referred hereinafter as the palm segment of the glove opening. While the opposite periphery of the glove opening along the rear side of the glove opening is referred hereinafter as the rear segment of the glove opening. The palm segment and the rear segment are along the circumference of the glove opening.

The upper segment of the sleeve opening 12 can be coupled with the rear segment of the glove opening 28. As shown in FIG. 1, the glove is stowed over the upper portion 25 of the sleeve 10 with the rear side of the glove in contact with the outer surface of the sleeve. Visible in FIG. 1 is the palm side 26 of the glove 24. The upper segment of the sleeve opening 12 is coupled with the rear segment of the glove opening 28. The two can be coupled by stitching the edges of the glove opening and the sleeve opening. The first seam 30 of the upper segment of the sleeve opening 12 and the rear segment of the glove opening 28 can be hidden by a hem liner that is attached while sewing the two edges. The opposite edge of the glove opening i.e. the palm segment of the glove opening is coupled to a flap.

FIG. 1 shows a substantial trapezium flap 32 secured over the palm side of the glove. The flap 32 is shown by the dotted texture to distinguish it from the glove. The flap is a flexible and stretchable piece of fabric that is having a front edge and an opposite rear edge 34. The flap is also having to opposite side edges. The front edge of the flap is coupled with the palm segment of the glove opening 12. The two can be coupled by stitching the edges of the flap and the glove opening. The second seam 34 of the front edge of the flap and the palm segment of the glove opening can be hidden by a hem liner that is attached while sewing the two edges. Opposite two corners 36 of the rear edge 34 of the flap are coupled to the upper portion 16 of the sleeve 10. The two corners can be stitched, pasted, bonded, and like to the sleeve. The three edges of the flap other than the front edge are unbonded.

Figure 3:
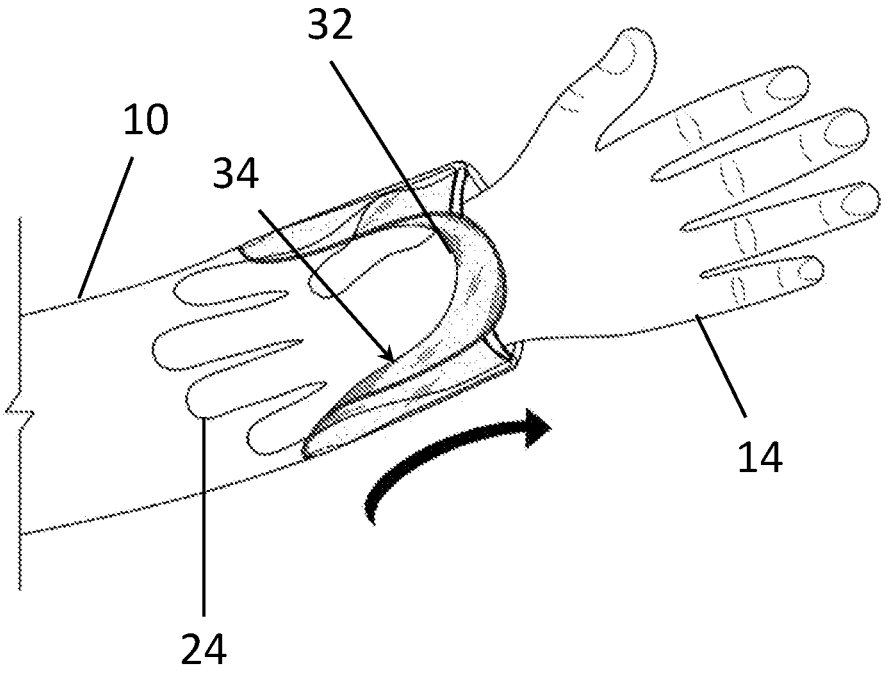
FIG. 3 shows the flap pulled towards the hand, according to an exemplary embodiment of the present invention.
Figure 4:
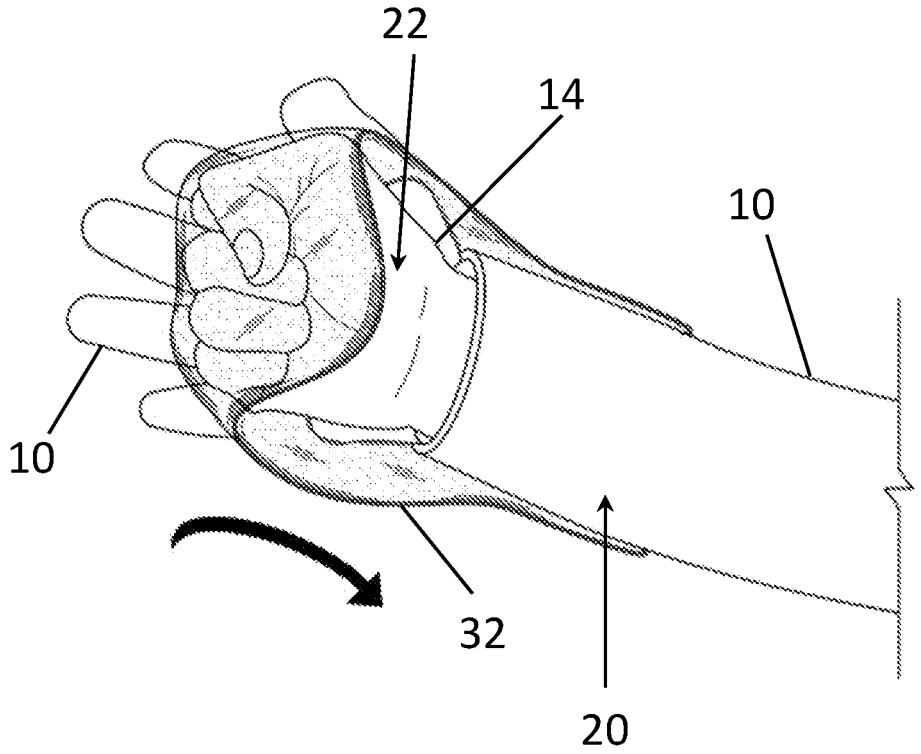
FIG. 4 shows the fingers folded to form a fist, the flap in-side-out and pulled over the fist, the glove is moved towards the fist, according to an exemplary embodiment of the present invention.

FIG. 2 show a right hand 14 extended from the sleeve opening 12. The sleeve is for the right arm and the glove is for the right hand. It is to be understood that the right hand is used for illustration of the invention and the sleeve of either hands or both hands can embody the disclosed invention. The glove is shown stowed over the upper portion of the sleeve. FIG. 3 shows the flap 32 through its rear edge 34 pulled towards the hand 14. To don the glove, a user can grab the rear edge 34 of the flap through his other hand and pull the flap towards the hand. The arrow shows the angular direction of movement of the rear edge of the flap. In this case, the user can use his left hand to grab the flap at its rear edge. Because of the stretchability of the flap, the flap is pulled towards the hand, while the corners of the rear edge are stitched to the sleeve. While the flap is pulled towards the hand, the fingers can be folded to form a fist. FIG. 4 shows the fingers folded to form the fist. Now the flap could be easily pulled to pass over the fist towards the other side of the hand. FIG. 4 shows the flap having in-side-out and covering the fist. The arrows show the angular direction in which the rear edge of the flap has to turn. The rear edge of the flap is pulled in an angular direction about 360 degrees, inverting the flap on the opposite side of the sleeve. As the flap is stretched towards the hand, the glove also moves forwards towards the hand. FIG. 4 shows the glove positioned at an angle in the direction of the hand. Also, the glove opening is pulled by the flap towards the fist. As the flap passes over the fist, the user can start opening the fist and inserting the hand through the glove opening into the glove.

Figure 5:
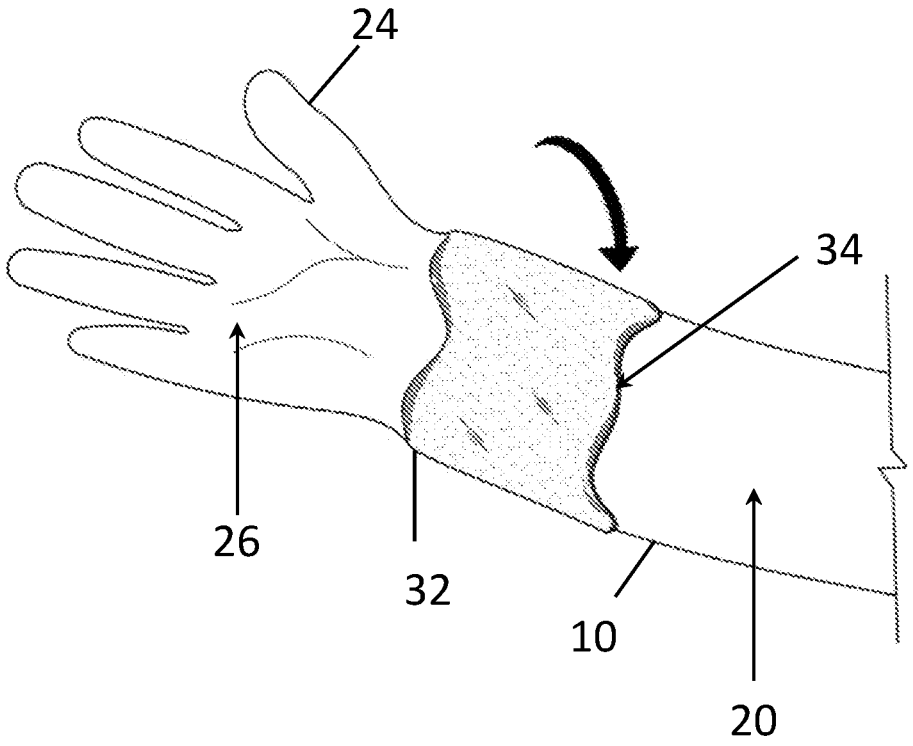
FIG. 5 shows the flap inverted over lower portion of the sleeve and the glove donned in the hand, according to an exemplary embodiment of the present invention.
Figure 6:
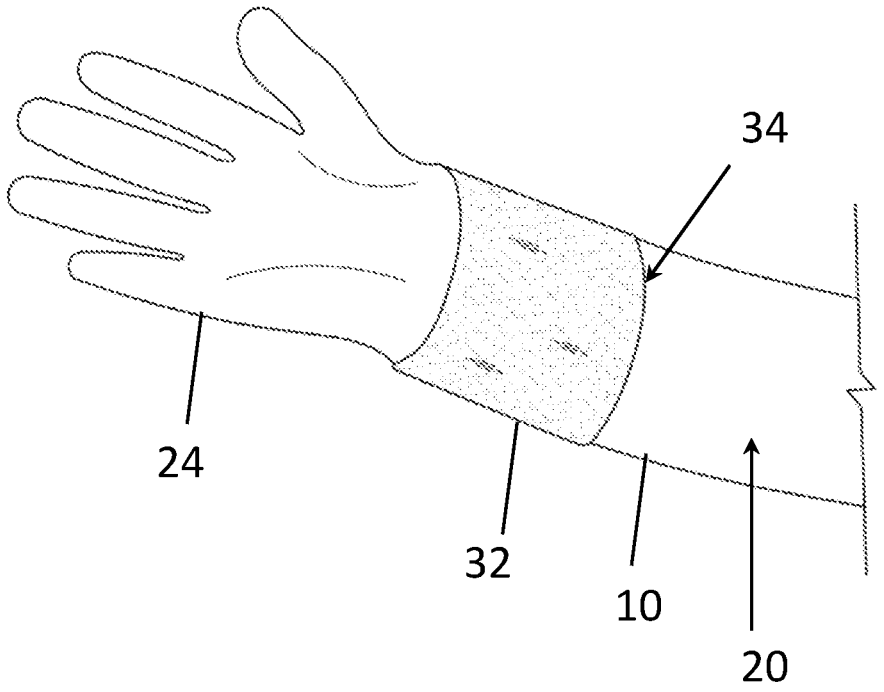
FIG. 6 shows the glove in donning position and the flap having in-side-out stowed on the opposite side of the sleeve.

FIG. 5 shows the flap 32 inverted on the lower position 20 of the sleeve 10 and the glove 24 is the donned position. Now the user can release the flap which can position in the inverted position on the lower portion of the sleeve. FIG. 6 shows the donned glove 24 and the flap 32 being inverted and stretched on the opposite side i.e. lower portion 20 of the sleeve 10.

Now to take-off the glove, the user can repeat the above process. First, grab the rear edge 34 of the flap 32 shown in FIG. 6. Thereafter, the rear edge 34 can be pulled towards the hand in an angular direction. The pulling of the flap causes the glove to come out of the fingers. Once the finger portion of the glove is out from the fingers, the hand can be clenched to form the fist. Thereafter, the flap can continue to be pulled over to the other side of the sleeve i.e. towards the upper portion of the sleeve. The glove is removed from the hands and moves with the flap toward the upper portion of the sleeve and stowed. The flap can be released to stretch itself on the upper portion 16 of the sleeve as shown in FIG. 2.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An upper-body apparel comprising:

a sleeve having an opening configured for extending a hand of a wearer there through, the sleeve has an upper portion and a lower portion, the sleeve opening has an upper segment and a lower segment along a circumference of the sleeve opening, the upper segment extends along the upper portion of the sleeve and the lower segment extends along the lower portion of the sleeve;

a glove that has a palm side, a rear side, and a glove opening, a palm segment of a periphery of the glove opening extends along the palm side of the glove, and a rear segment of the periphery of the glove opening extends along the rear side of the glove; and a flap, the flap has a front edge, an opposite rear edge, a left edge, and a right edge, the rear edge having two opposite corners, the flap is made of stretchable material;

wherein the upper segment of the sleeve opening is coupled to the rear segment of the glove opening, wherein the palm segment of the glove opening is coupled to the front edge of the flap, the two opposite corners of the rear edge of the flap are coupled to the upper portion of the sleeve, the left edge, the right edge, and the rear edge of the flap between the two opposite corners are not coupled to the sleeve, wherein the glove is sandwiched between the upper portion of the sleeve and the flap.

2. The upper-body apparel according to claim 1, wherein the flap is stretchable such that to be pulled in an angular direction and invert over the lower portion of the sleeve.

3. The upper-body apparel according to claim 2, wherein the glove is configured to switch between a stowed position and a donned position, the glove in the stowed position is sandwiched between the flap and the upper portion of the sleeve, the glove in the donned position is adapted to cover the hand and the flap is over the lower portion of the sleeve.

4. A method of donning a glove, the method comprising:

providing an apparel, the apparel comprising:

a sleeve having an opening configured for extending a hand of a wearer there through, the sleeve has an upper portion and a lower portion, the sleeve opening has an upper segment and a lower segment extending along a circumference of the sleeve opening, the upper segment extends along the upper portion of the sleeve and the lower segment extends along the lower portion of the sleeve;

a glove, the glove has a palm side, a rear side, and a glove opening, a palm segment of a periphery of the glove opening extends along the palm side of the glove, and a rear segment of the periphery of the glove opening extends along the rear side of the glove; and a flap, the flap has a front edge, an opposite rear edge, a left edge, and a right edge, the rear edge has two opposite corners, the flap is made of stretchable material;

wherein the upper segment of the sleeve opening is coupled to the rear segment of the glove opening, wherein the palm segment of the glove opening is coupled to the front edge of the flap, the two opposite corners of the rear edge of the flap are coupled to the upper portion of the sleeve, the left edge, the right edge, and the rear edge of the flap are not coupled to the sleeve, wherein the glove is sandwiched between the upper portion of the sleeve and the flap;

clenching the hand to form a fist;

pulling the rear edge of the flap in an angular direction towards the fist until the glove opening is positioned over the fist;

inserting the fist into the glove opening while simultaneously unfolding the fingers;

inverting the flap towards the lower portion of the sleeve while inserting the hand into the glove; and releasing the flap, wherein upon releasing, the flap is inverted over the lower portion of the sleeve.

5. The method according to claim 4, wherein the apparel is a pullover.

6. The method according to claim 5, wherein the pullover is a jacket.

7. The method according to claim 5, wherein the pullover is a jersey.

8. The method according to claim 5, wherein the sleeve is interchangeably coupled to the pullover through a fastener.

9. Method according to claim 8, wherein the fastener is a zipper.

10. The upper-body apparel according to claim 1, wherein the upper-body apparel is a pullover.

11. The upper-body apparel according to claim 10, wherein the pullover is a jacket.

12. The upper-body apparel according to claim 10, wherein the pullover is a jersey.

13. The upper-body apparel according to claim 10, wherein the sleeve is interchangeably coupled to the pullover through a fastener.

14. The upper-body apparel according to claim 13, wherein the fastener is a zipper.

* * * * *